US010080432B2

(12) United States Patent
Turano

(10) Patent No.: US 10,080,432 B2
(45) Date of Patent: Sep. 25, 2018

(54) PAINT ROLLER STORAGE SYSTEM

(71) Applicant: David Turano, Bonita Springs, FL (US)

(72) Inventor: David Turano, Bonita Springs, FL (US)

( * ) Notice: Subject to any disclaimer, the term of this patent is extended or adjusted under 35 U.S.C. 154(b) by 0 days.

(21) Appl. No.: 15/441,442

(22) Filed: Feb. 24, 2017

(65) Prior Publication Data

US 2018/0242734 A1 Aug. 30, 2018

(51) Int. Cl.

| | |
|---|---|
| ***A47B 81/00*** | (2006.01) |
| ***B05C 17/02*** | (2006.01) |
| ***B44D 3/12*** | (2006.01) |
| *B44D 3/00* | (2006.01) |

(52) U.S. Cl.

CPC ..... *A47B 81/007* (2013.01); *B05C 17/0245* (2013.01); *B44D 3/123* (2013.01); *B44D 3/125* (2013.01); *B44D 3/00* (2013.01)

(58) Field of Classification Search

CPC ... B05C 17/0245; B05C 21/00; A47B 81/007; A47B 73/00; A47B 73/006; B44D 3/00; B44D 3/006; B44D 3/125; B44D 3/123; A45D 44/18; B65D 81/26; B25H 3/04; A47F 7/0028; A46B 17/02; A46B 2200/202

USPC ..... 211/74, 75, 60.1, 65, 70.6, 87.01; 15/236.03, 257.01, 257.06; 206/15.3, 206/361, 362, 362.1, 362.2, 362.3, 15.2, 206/209; 248/110, 113, 111; 220/697

See application file for complete search history.

(56) References Cited

U.S. PATENT DOCUMENTS

| | | | | | |
|---|---|---|---|---|---|
| 3,746,179 | A | * | 7/1973 | Paumgardhen | A47B 73/00 182/196 |
| D273,647 | S | * | 5/1984 | Kandarian | D6/570 |
| 4,897,893 | A | * | 2/1990 | Barker | B05C 17/02 15/230.11 |
| 5,025,936 | A | * | 6/1991 | Lamoureaux | A47B 73/006 211/74 |
| 5,533,617 | A | * | 7/1996 | Von Flatern | B44D 3/125 206/15.3 |
| 5,546,625 | A | * | 8/1996 | Mealey, Sr. | B05C 21/00 15/105 |
| D378,482 | S | * | 3/1997 | Hall, Sr. | D6/552 |
| 5,645,091 | A | | 7/1997 | Hoeft | |
| 6,125,497 | A | * | 10/2000 | Galbreath | B05C 17/0245 15/104.04 |
| 6,752,267 | B2 | | 6/2004 | MacPherson | |

(Continued)

FOREIGN PATENT DOCUMENTS

| | | | | | |
|---|---|---|---|---|---|
| GB | 2141921 | A | * | 1/1985 | A47B 73/00 |
| WO | WO2004039213 | | | 5/2004 | |

*Primary Examiner* — Hiwot E Tefera

(57) ABSTRACT

A paint roller storage system for storing a plurality of paint rollers includes a plurality of paint rollers. Each of the paint rollers has a handle and a roller that is rotatably coupled to the handle. The roller corresponding to each of the paint rollers comprises a plurality of wires. A storage rack is provided and the storage rack is selectively coupled to a support surface. The storage rack has a plurality of apertures. The roller corresponding to each of the paint rollers is removably inserted through an associated one of the apertures to store each of the paint rollers. The storage rack inhibits the wires corresponding to each of the paint rollers from becoming deformed during storage.

8 Claims, 3 Drawing Sheets

(56) References Cited

U.S. PATENT DOCUMENTS

| | | | | |
|---|---|---|---|---|
| 7,234,602 | B2 | 6/2007 | Roberti | |
| D568,697 | S * | 5/2008 | Allen | D7/708 |
| 8,100,272 | B1 | 1/2012 | Schaefer | |
| D675,490 | S * | 2/2013 | Dara | D7/701 |
| D680,393 | S | 4/2013 | Hendrick et al. | |
| 8,640,889 | B2 * | 2/2014 | Gasper | A47B 73/00 211/74 |
| 2002/0138935 | A1 * | 10/2002 | Lanz | B05C 17/02 15/230.11 |
| 2007/0017884 | A1 * | 1/2007 | Yang | A47B 73/006 211/74 |
| 2007/0235395 | A1 | 10/2007 | Mondale | |
| 2010/0095469 | A1 * | 4/2010 | Hu | B05C 17/02 15/230.11 |
| 2011/0108501 | A1 | 5/2011 | Ambrosen | |
| 2012/0175278 | A1 * | 7/2012 | Stevens | B44D 3/123 206/373 |
| 2014/0332642 | A1 * | 11/2014 | Lim | A46B 17/04 248/111 |

* cited by examiner

PAINT ROLLER STORAGE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing a plurality of paint rollers.

BRIEF SUMMARY OF THE INVENTION

An embodiment of the disclosure meets the needs presented above by generally comprising a plurality of paint rollers. Each of the paint rollers has a handle and a roller that is rotatably coupled to the handle. The roller corresponding to each of the paint rollers comprises a plurality of wires. A storage rack is provided and the storage rack is selectively coupled to a support surface. The storage rack has a plurality of apertures. The roller corresponding to each of the paint rollers is removably inserted through an associated one of the apertures to store each of the paint rollers. The storage rack inhibits the wires corresponding to each of the paint rollers from becoming deformed during storage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
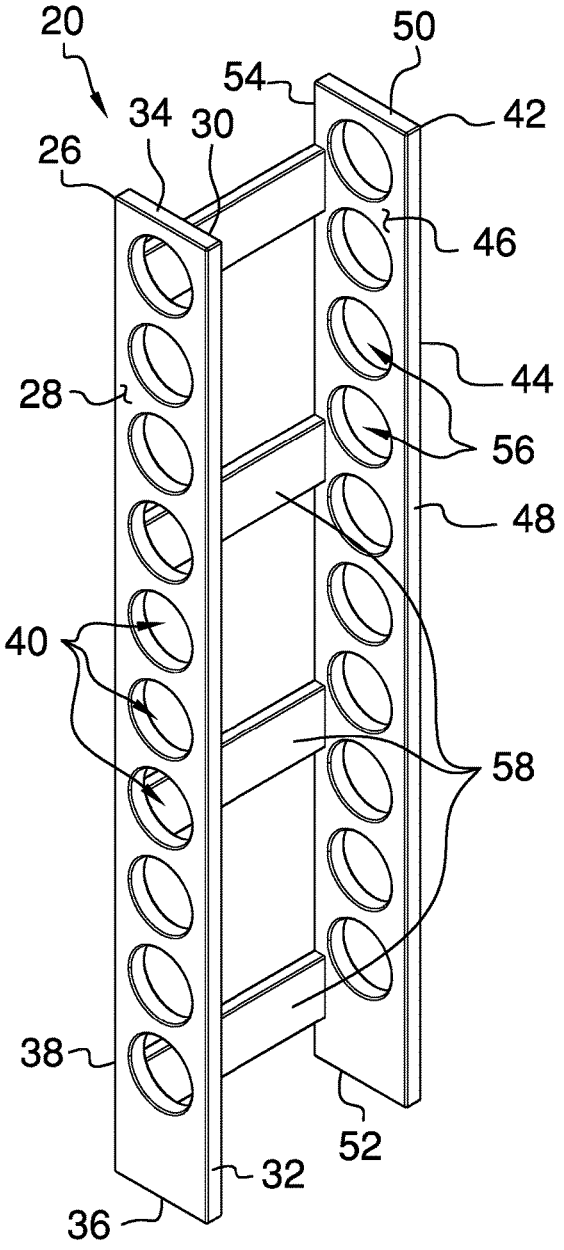
FIG. 1 is a front perspective view of a paint roller storage system according to an embodiment of the disclosure.
Figure 2:
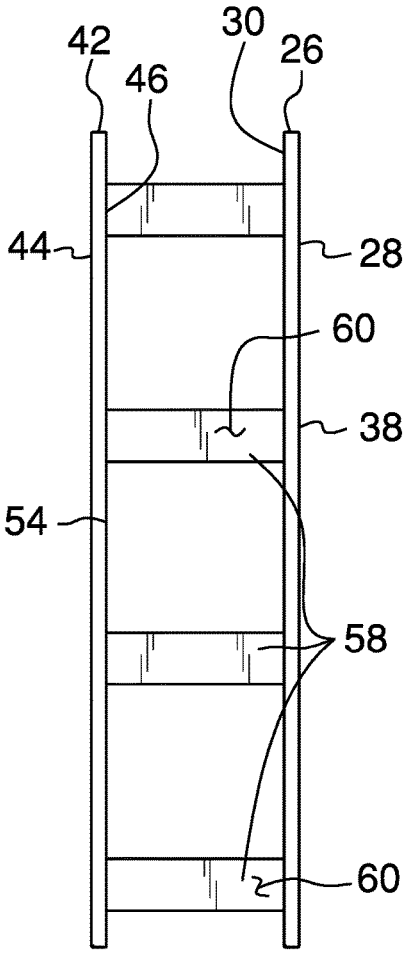
FIG. 2 is a back view of an embodiment of the disclosure.
Figure 3:
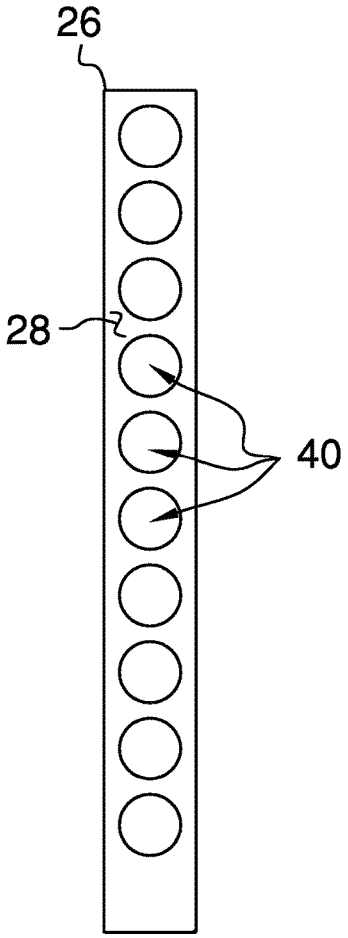
FIG. 3 is a right side view of an embodiment of the disclosure.
Figure 4:
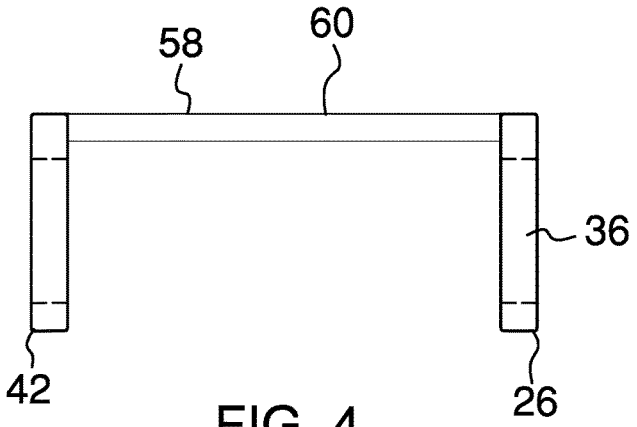
FIG. 4 is a bottom view of an embodiment of the disclosure.
Figure 5:
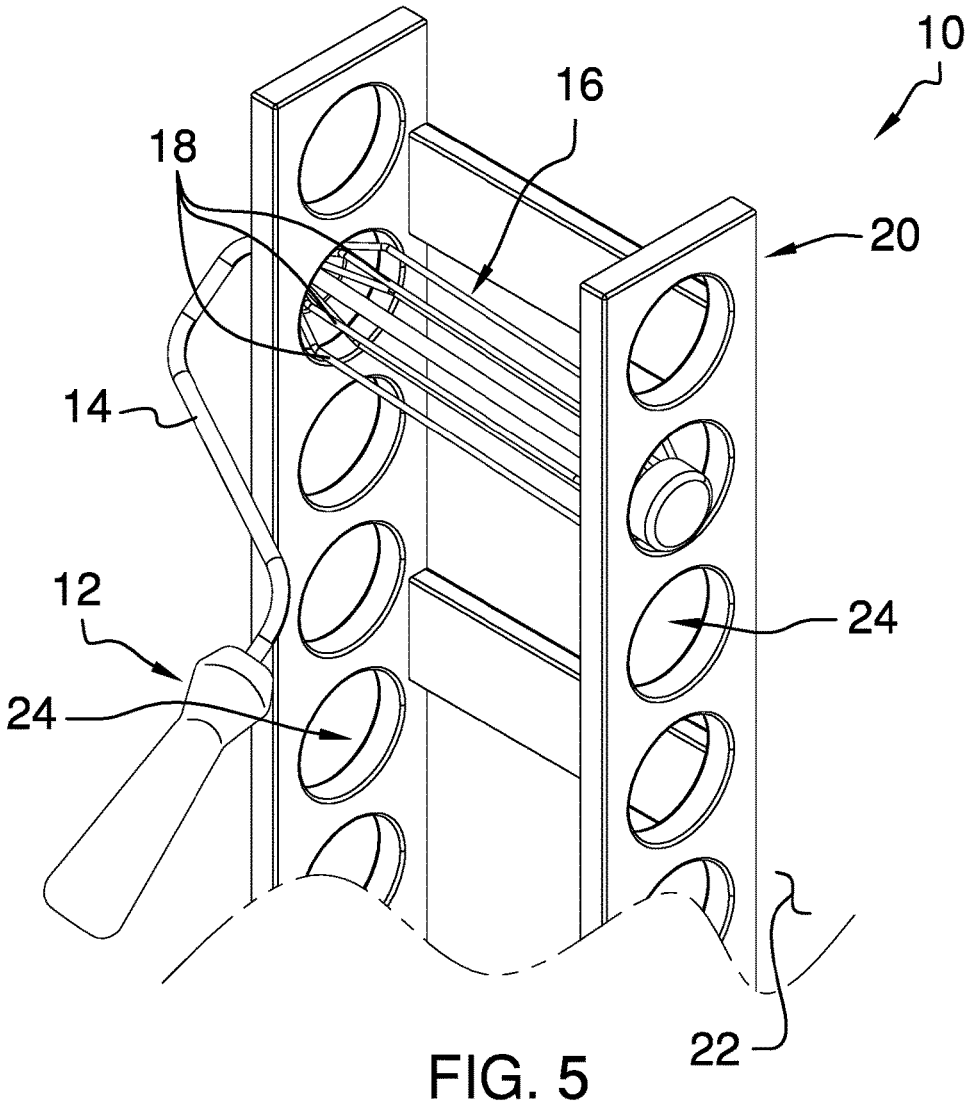
FIG. 5 is a perspective in-use view of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the paint roller storage system 10 generally comprises a plurality of paint rollers 12. Each of the paint rollers 12 is selectively manipulated to apply paint to a surface. Each of the paint rollers 12 has a handle 14 and a roller 16 that is rotatably coupled to the handle 14. The roller 16 corresponding to each of the paint rollers 12 comprise a plurality of wires 18 and each of the wires 18 extends along an entire length of the roller 16. Moreover, each of the paint rollers 12 may be paint rollers 12 of any conventional design.

A storage rack 20 is provided and the storage rack 20 is selectively coupled to a support surface 22. The support surface 22 may be an internal wall in a vehicle, a room or any other vertical support surface. The storage rack 20 has a plurality of apertures 24. The roller 16 corresponding to each of the paint rollers 12 is removably inserted through an associated one of the apertures 24 to store each of the paint rollers 12. Moreover, the storage rack 20 inhibits the wires 18 corresponding to each of the paint rollers 12 from becoming deformed during storage.

The storage rack 20 comprises a first panel 26 that has a first surface 28, a second surface 30 and a perimeter edge 32 extending therebetween. The perimeter edge 32 has a top side 34, a bottom side 36 and a back side 38. The first panel 26 is elongated between the top side 34 and the bottom side 36 and the plurality of apertures 24 includes a set of first apertures 40. Each of the first apertures 40 extends through the first surface 28 and the second surface 30. Moreover, the first apertures 40 are spaced apart from each other and are distributed between the top side 34 and the bottom side 36.

A second panel 42 is provided that has a primary surface 44, a secondary surface 46 and a peripheral edge 48 extending therebetween. The peripheral edge 48 has an upper side 50, a lower side 52 and a rear side 54. The second panel 42 is elongated between the upper side 50 and the lower side 52 and the plurality of apertures 24 includes a set of second apertures 56. Each of the second apertures 56 extends through the primary surface 44 and the secondary surface 46. Moreover, the second apertures 56 are spaced apart from each other and are distributed between the upper side 50 and the lower side 52.

A plurality of spacers 58 is provided and each of the spacers 58 is coupled between the second surface 30 of the first panel 26 and the secondary surface 46 of the second panel 42. Thus, the first panel 26 is spaced from the second panel 42. Each of the first apertures 40 is aligned with an associated one of the second apertures 56. The spacers 58 are spaced apart from each other and are vertically distributed on the first panel 26 and the second panel 42.

Each of the spacers 58 is aligned with the back side 38 of the first panel 26 and the rear side 54 of the second panel 42. Moreover, each of the spacers 58 has a rearward surface 60 and the rearward surface 60 is selectively attached to the support surface 22. Each of the spacers 58 is attached to the support surface 22 with a plurality of fasteners or the like. The storage rack 20 is vertically oriented on the support surface 22. The roller 16 corresponding to each of the paint rollers 12 is removably inserted through a corresponding pair of the first 40 and second 56 apertures. In this way the plurality of paint rollers 12 is stored and organized.

In use, the spacers 58 are attached to the support surface 22 having the storage rack 20 being vertically oriented on the support surface 22. The roller 16 corresponding to each of the paint rollers 12 is selectively extended through the associated pair of first 40 and second 56 apertures. In this way each of the paint rollers 12 is stored in the storage rack 20. Additionally, the storage rack 20 inhibits the wires 18 corresponding to each of the paint rollers 12 from being deformed during storage. Each of the paint rollers 12 is selectively removed from the storage rack 20 for use during painting.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint roller storage system comprising:

a plurality of paint rollers, each of said paint rollers being configured to be manipulated to apply paint to a surface, each of said paint rollers having a handle and a roller being rotatably coupled to said handle, said roller corresponding to each of said paint rollers comprising a plurality of wires, each of said wires extending along an entire length of said roller; and a storage rack being configured to be coupled to a support surface, said storage rack comprising a first panel having a plurality of first apertures, and a second panel having a plurality of second apertures, a diameter of each of said first apertures being greater than an outer circumference defined by said wires corresponding to each of said paint rollers, said roller corresponding to each of said paint rollers being removably inserted through an associated one of said first apertures and one of said second apertures to store each of said paint rollers wherein said storage rack inhibits said wires corresponding to each of said paint rollers from becoming deformed during storage.

2. The system according to claim 1, wherein said first panel having a first surface, a second surface and a perimeter edge extending therebetween, said perimeter edge having a top side, a bottom side and a back side, said first panel being elongated between said top side and said bottom side.

3. The system according to claim 2, wherein each of said first apertures extending through said first surface and said second surface, said first apertures being spaced apart from each other and being distributed between said top side and said bottom side.

4. The system according to claim 1, wherein said second panel having a primary surface, a secondary surface and a peripheral edge extending therebetween, said peripheral edge having an upper side, a lower side and a rear side, said second panel being elongated between said upper side and said lower side.

5. The system according to claim 4, wherein each of said second apertures extending through said primary surface and said secondary surface, said second apertures being spaced apart from each other and being distributed between said upper side and said lower side.

6. The system according to claim 1, wherein said first panel having a primary surface and said second panel having a secondary surface and the storage rack further comprising a plurality of spacers, each of said spacers being coupled between said primary surface of said first panel and said secondary surface of said second panel such that said first panel is spaced from said second panel, each of said first apertures being aligned with an associated one of said second apertures.

7. The system according to claim 6, wherein:

said first panel has a back side;

said second panel has a rear side; and said spacers are spaced apart from each other and are vertically distributed on said first panel and said second panel, each of said spacers being aligned with said back side of said first panel and said rear side of said second panel, each of said spacers having a rearward surface, said rearward surface being configured to be attached to the support surface, said roller corresponding to each of said paint rollers being removably inserted through a corresponding pair of said first and second apertures.

8. A paint roller storage system comprising:

a plurality of paint rollers, each of said paint rollers being configured to be manipulated to apply paint to a surface, each of said paint rollers having a handle and a roller being rotatably coupled to said handle, said roller corresponding to each of said paint rollers comprising a plurality of wires, each of said wires extending along an entire length of said roller; and a storage rack being configured to be coupled to a support surface, said storage rack having a plurality of apertures, a diameter of each of said apertures being greater than an outer circumference defined by said wires corresponding to each of said paint rollers, said roller corresponding to each of said paint rollers being removably inserted through an associated one of said apertures to store each of said paint rollers wherein said storage rack inhibits said wires corresponding to each of said paint rollers from becoming deformed during storage, said storage rack comprising:

a first panel having a first surface, a second surface and a perimeter edge extending therebetween, said perimeter edge having a top side, a bottom side and a back side, said first panel being elongated between said top side and said bottom side, said plurality of apertures including a set of first apertures, each of said first apertures extending through said first surface and said second surface, said first apertures being spaced apart from each other and being distributed between said top side and said bottom side, a second panel having a primary surface, a secondary surface and a peripheral edge extending therebetween, said peripheral edge having an upper side, a lower side and a rear side, said second panel being elongated between said upper side and said lower side, said plurality of apertures including a set of second apertures, each of said second apertures extending through said primary surface and said secondary surface, said second apertures being spaced apart from each other and being distributed between said upper side and said lower side, and a plurality of spacers, each of said spacers being coupled between said second surface of said first panel and said secondary surface of said second panel such that said first panel is spaced from said second panel, each of said first apertures being aligned with an associated one of said second apertures, said spacers being spaced apart from each other and being vertically distributed on said first panel and said second panel, each of said spacers being aligned with said back side of said first panel and said rear side of said second panel, each of said spacers having a rearward surface, said rearward surface being configured to be attached to the support surface, said roller corresponding to each of said paint rollers being removably inserted through a corresponding pair of said first and second apertures.

* * * * *